US005242526A

United States Patent [19]

Adair

[11] Patent Number: 5,242,526

[45] Date of Patent: Sep. 7, 1993

[54] METHOD AND APPARATUS FOR APPLYING TAGS OR LABELS TO ARTICLES

[75] Inventor: Randy P. Adair, Akron, Ohio

[73] Assignee: Sterling, Inc., Akron, Ohio

[21] Appl. No.: 726,783

[22] Filed: Jul. 8, 1991

[51] Int. Cl.[5] ..... B65C 9/00

[52] U.S. Cl. ..... 156/475; 156/479; 156/492; 156/542; 156/249

[58] Field of Search ..... 156/249, 235, 213, 216, 156/475, 479, 492, 542

[56] References Cited

U.S. PATENT DOCUMENTS

| | | | |
|---|---|---|---|
| 4,504,336 | 3/1985 | Talalay | 156/492 X |
| 4,561,923 | 12/1985 | DeLorenzi et al. | 156/492 X |
| 4,596,620 | 6/1986 | Karolyi | 156/216 |
| 5,022,954 | 6/1991 | Plaessmann | 156/542 |

*Primary Examiner*—David A. Simmons
*Assistant Examiner*—James J. Engel, Jr.
*Attorney, Agent, or Firm*—Reese Taylor

[57] ABSTRACT

An apparatus for continuously applying tags to rings or the like includes at least one conveyor having a series of ring carrying posts movable into registry with a tag applicator which receives a tag from a supply source, is insertable into the ring and collapsible about the ring to position the tag about the ring and then movable out of the ring. The tag applicator includes a pair of applicator arms movable between an open, coextensive position to receive the tag and a closed, juxtaposed position to place the tag about the ring. Carousel supply means are disclosed which include ring carrying posts movable to a position wherein rings may be selectively deposited on the ring carrying posts. The method includes operating the conveyor continuously, supplying rings to the ring carrying posts, supplying tags to the applicator arms, inserting the applicator arms into the rings and affixing the tags to the rings and retracting the applicator arms.

24 Claims, 11 Drawing Sheets

METHOD AND APPARATUS FOR APPLYING TAGS OR LABELS TO ARTICLES

BACKGROUND OF THE INVENTION

This invention relates in general to the application of labels or tags to small articles and relates in particular to a method and apparatus for the application, on a continuous basis, of such labels or tags to articles of jewelry, such as rings.

DESCRIPTION OF THE PRIOR ART

It is well known in the art of merchandising to apply price tags or other identifying labels to articles to be offered for sale to the public. Such tags are used to provide a variety of information both for the purchaser and the seller.

It is also well known that these identifying labels or tags can be, for example, in the jewelry art, pressure-sensitive labels which can be placed about, for example, a ring, folded upon themselves, and thereby affixed to the article. Various information, such as price, size, quality, etc., can be conveyed to the ultimate customer in this fashion. It is also known that tags or labels of this type can be coated with a layer of pressure-sensitive adhesive and supplied on a sheet of release paper so that they can readily be removed from the release paper and affixed to the article.

In the prior art known to Applicant, this operation has generally been performed manually wherein the operator will pick up, for example, a ring, remove a tag or label from the release paper and wrap it around the ring, pressing the ends together to affix it thereto. As a practical matter, operators are capable of applying three or four such tags or labels per minute, and this method of operation is satisfactory up to a point. The obvious disadvantage, however, is that it is labor-intensive and slow.

It is, therefore, believed desirable to automate the process and increase the speed and production quantities possible while simultaneously reducing the manpower required to tag or label a given quantity of articles.

It has been found that, by automating the process and providing a method and apparatus for continuously applying tags or labels to articles such as rings, production can be increased from three or four per minute to anywhere from twenty to two hundred per minute, depending upon the speed with which the apparatus is operated.

SUMMARY OF THE INVENTION

It accordingly becomes a principal object of this invention to provide such a continuous method and apparatus for applying tags or labels to rings or similar articles.

In accomplishing the above-noted object, it has been found that it is possible to provide conveying means for carrying or advancing the articles along a predetermined path of movement and to provide supply means for supplying the tags or labels to a position overlying the conveying means and to coordinate the movement of the tags and articles so that an individual tag or label is presented at a given location simultaneously with the arrival of an individual article.

It has also been found that it is possible to provide tag applying means that are positioned above the path of movement of the articles and which receive the individual tags from the supply means and attach them to the articles.

It has further been found that this operation can be facilitated by directing the release paper carrying the tags or labels from a roll to a position adjacent the tag applying means and automatically removing them by a combination of suction and air pressure and then affixing them temporarily to the tag applying means which can then be indexed into the ring and collapsed upon itself to wrap the tag or label about the ring.

It has further been found that the tag applying means can then be extracted from the ring, the conveying means can be indexed, and the supply means can be indexed and the operation can be repeated with maximum efficiency and speed.

Production of an improved method and apparatus for applying tags or labels to rings of the character above-described accordingly becomes the principal object of this invention with other objects thereof becoming more apparent upon a reading of the following brief specification considered and interpreted in view of the accompanying drawings.

BRIEF DESCRIPTION OF THE EXEMPLARY EMBODIMENTS

Figure 1:
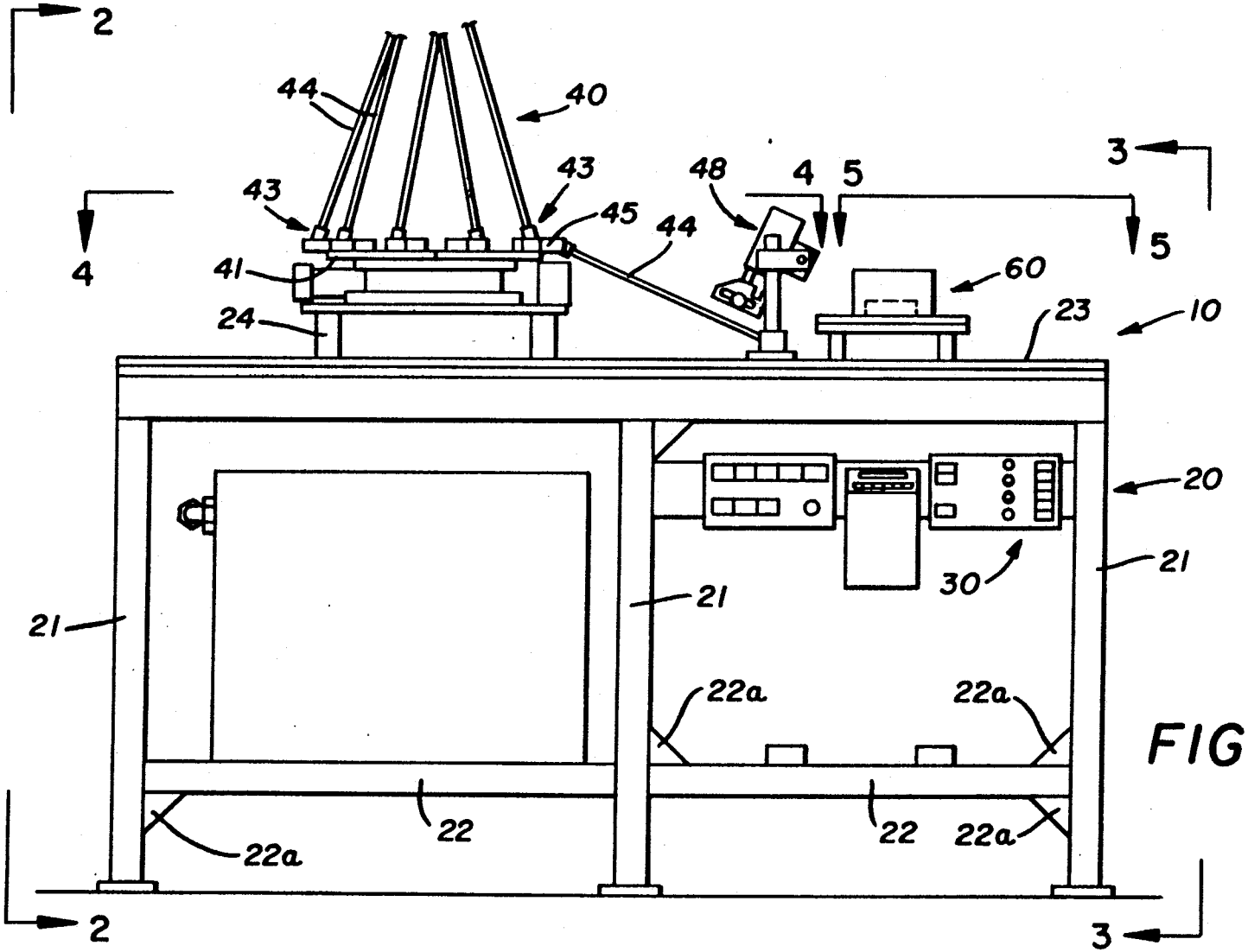
FIG. 1 is a side elevational view, partially schematic, illustrating the overall apparatus.
Figure 2:
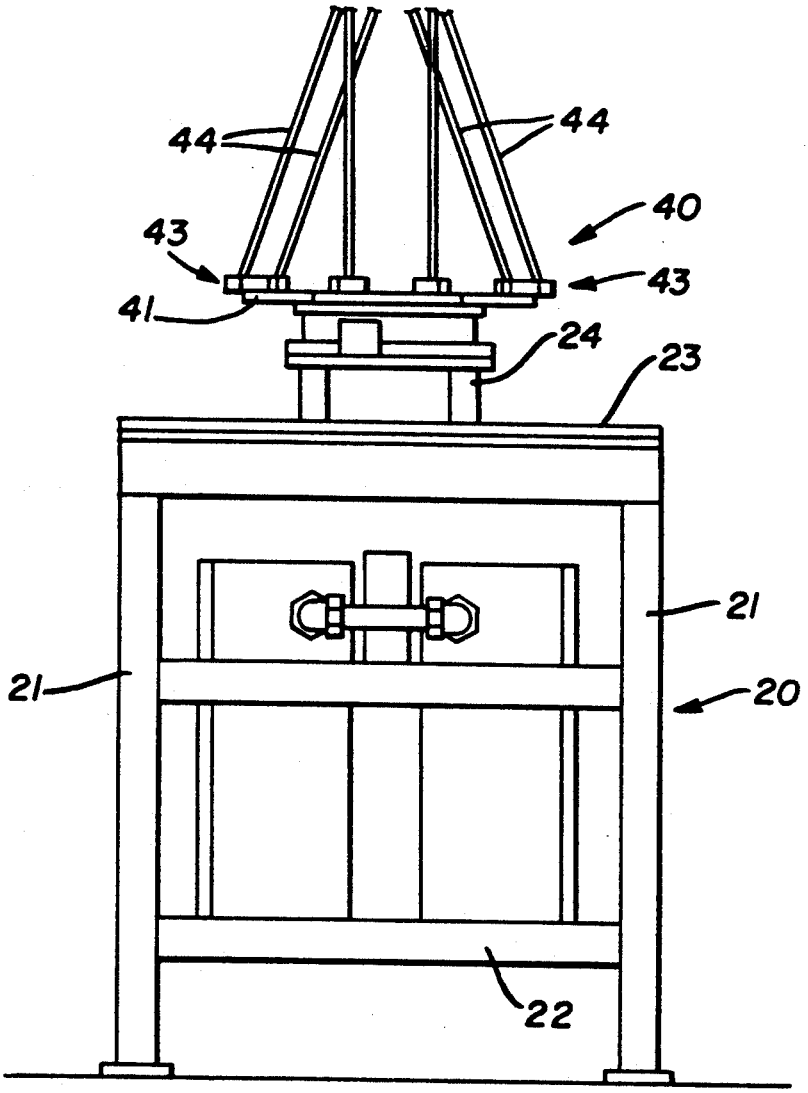
FIG. 2 is an elevational view taken along the line 2—2 of FIG. 1.

Turning first, then, to FIGS. 1 and 2 of the drawings, it will be noted that the overall apparatus, generally indicated by the numeral 10, includes a frame 20, a control panel 30, a carousel or article supply means 40, conveying means 50 and tag or label applying means 60.

Figure 3:
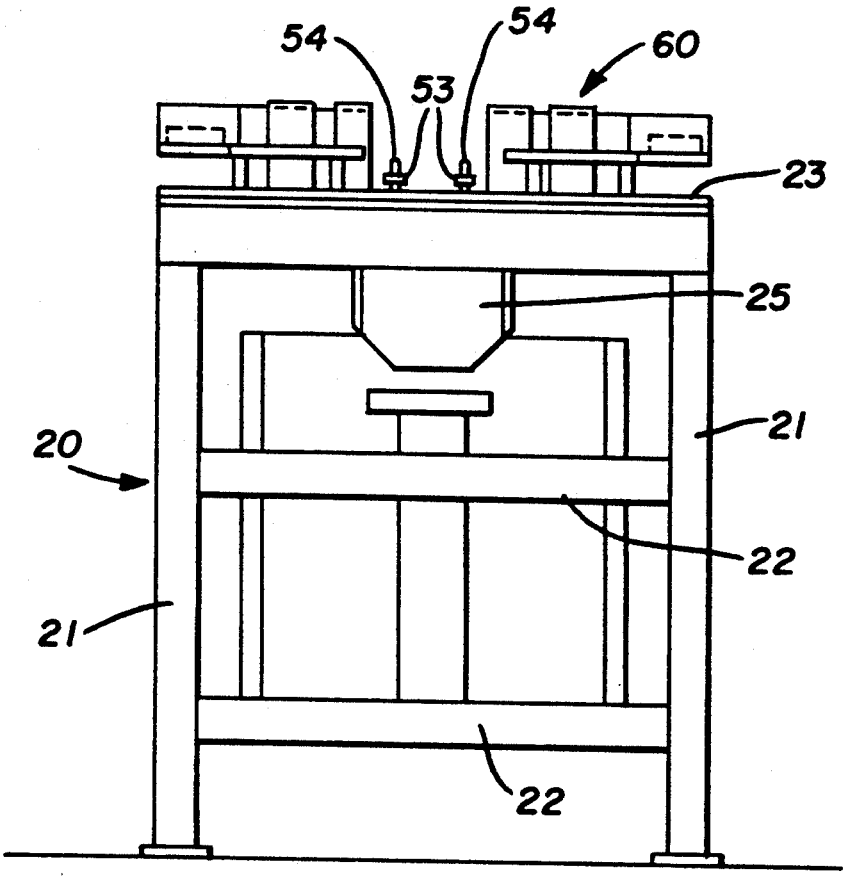
FIG. 3 is an end elevation taken along the line 3—3 of FIG. 1.

Referring to FIGS. 1 through 3 of the drawings, it will be noted that the frame means 20 includes the usual support legs 21,21, cross braces 22,22, reinforcing braces 22a, 22a and top surface 23. Also affixed to the frame 20 is an article receiving receptacle 25.

The control means 30 illustrated in FIG. 1 are mounted on frame means 20 and illustrated schematically only, it being felt that provision of the appropriate controls to operate the article supply means 40, conveying means 50 and tag or label applying means 60 is within the skill of one with ordinary skill in the art without undue experimentation.

Referring next, then, to FIGS. 1 and 2 of the drawings for a description of the carousel or article supply means 40, it will first be noted that the purpose of this arrangement is to supply the articles to the apparatus in a controlled fashion. It is believed apparent that this is one embodiment of a supply means and that others could also be substituted therefor including, but not limited to, manual loading. It will also be noted that hereafter the articles will be illustrated and described as finger rings for simplicity, but it should be noted that the invention is not to be limited thereby.

Figure 4:
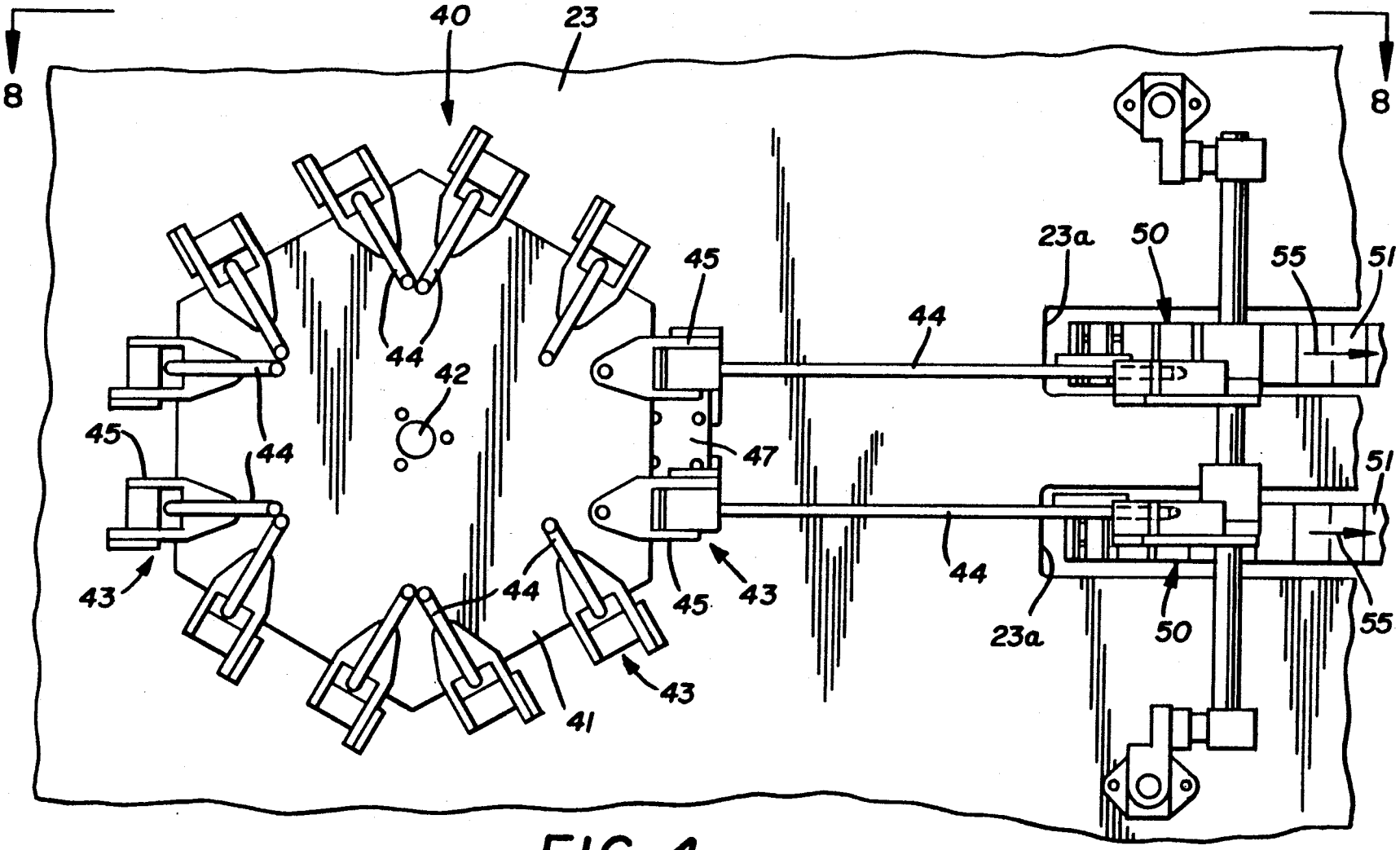
FIG. 4 is a partial top plan view of the apparatus.

With that in mind, and referring to FIGS. 1, 2, 4 and 8, it will be noted that the carousel or article supply means 40 generally includes an index table 41 which is mounted for rotational movement about the arm or shaft 42 (see FIG. 4). The index table 41 is supported on a mounting base 24 which is supported on top surface 23 of frame means 20 and is indexable about the axis of shaft 42 by a suitable motor for driving shaft 42.

Disposed about the periphery of the index table 41 are a plurality of supply arm assemblies 43,43. These consist of an elongate arm 44 in each case, mounted in a bracket 45, and, as can clearly be seen, for example, in FIG. 8 of the drawings, the arms 43,43 are selectively movable between an upright position and an extended position about pivot point 43a. As also can be clearly seen in FIG. 8 of the drawings, for example, the rings R can be placed over the arms 44 and, as the arms 44 are moved from the upright to the extended position by operation of the shaft 47, the rings will slide, by gravity, toward the top surface 23 of the base 20 and eventually onto the ring carriers which will be described below.

It will be understood that arms 44 are normally disposed in the position shown in FIG. 2 of the drawings in which position they are positioned for loading with rings. It will also be seen (FIG. 4) that they are intended to be utilized in pairs in the dual track system illustrated, although a single track operation is also possible.

Figure 8:
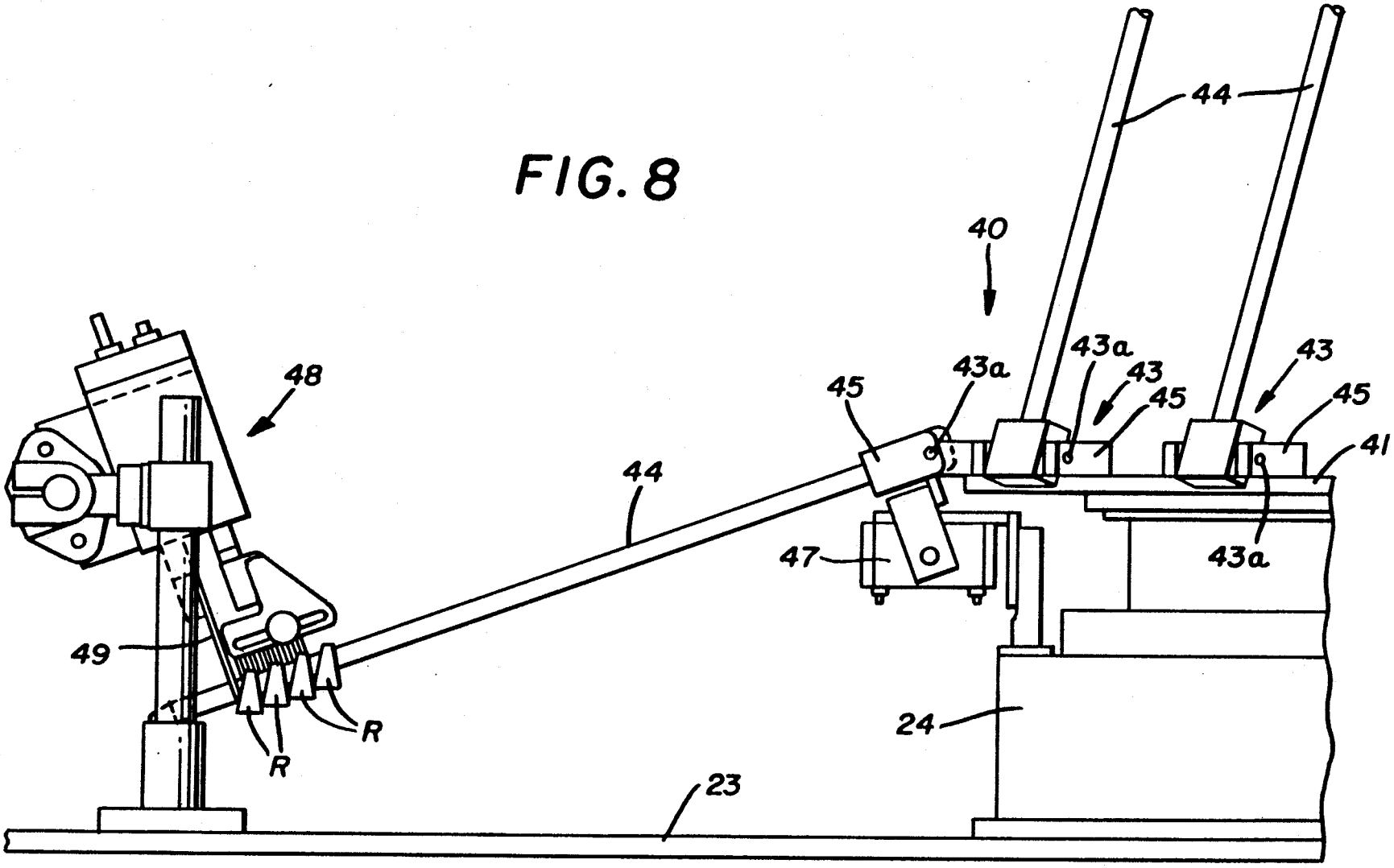
FIG. 8 is a sectional view taken along the line 8—8 of FIG. 4.
Figure 11:
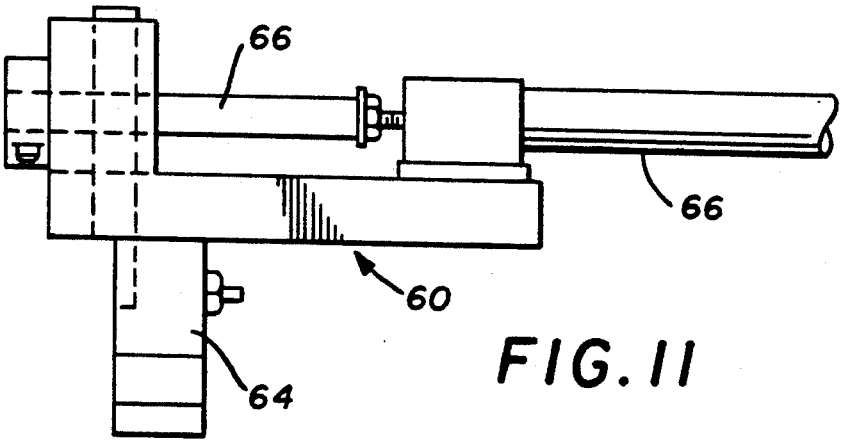
FIG. 11 is a sectional view taken along the line 11—11 of FIG. 9.

Further, it will be noted that when the index table 41 is rotated so that two arms 44 are in alignment with conveying means 50, control 47 can be activated to swing the arms to the position of FIGS. 1, 4 and 8 so that the rings R are in position above the ring carriers 52 of conveying means 50.

At this point, it is simply necessary to indicate that a control member 48 is provided adjacent the end of each arm 44 when in its extended position. The control member 48 has a projecting arm 49 which extends toward arm 44. This projecting arm 49 can be extended and retracted toward and away from arm 44 so as to permit an individual ring R to slide off the end of the arm 44 and onto the ring carrier which will be further described below. FIG. 8 illustrates this arrangement with it being understood that one ring R will be released from each arm 44 in each cycle of control means 48.

As previously noted, other supply means could be provided for the rings including manual loading onto the ring carriers if desired. It has, however, been found that utilization of this type of supply means makes it possible to automatically supply the rings, as required, rapidly and easily.

Figure 12A:
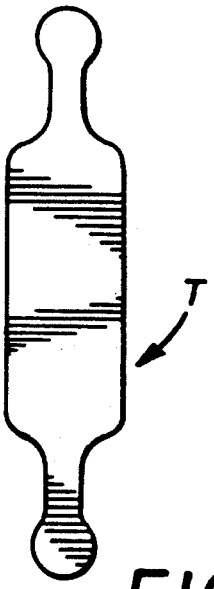
FIG. 12A is an elevational view of a typical tag or label.

It ought also to be noted at this point that the invention is illustrated and is being described in connection with parallel feeds so that two tags or labels T, as illustrated in FIG. 12A, are applied to two rings R in each operating cycle. In that regard, reference to FIG. 4 will show that two arms 44 are shown in the down or extended position. It will be appreciated that the invention is not intended to be limited to a dual path arrangement and could operate on a single path equally as well.

Figure 6:
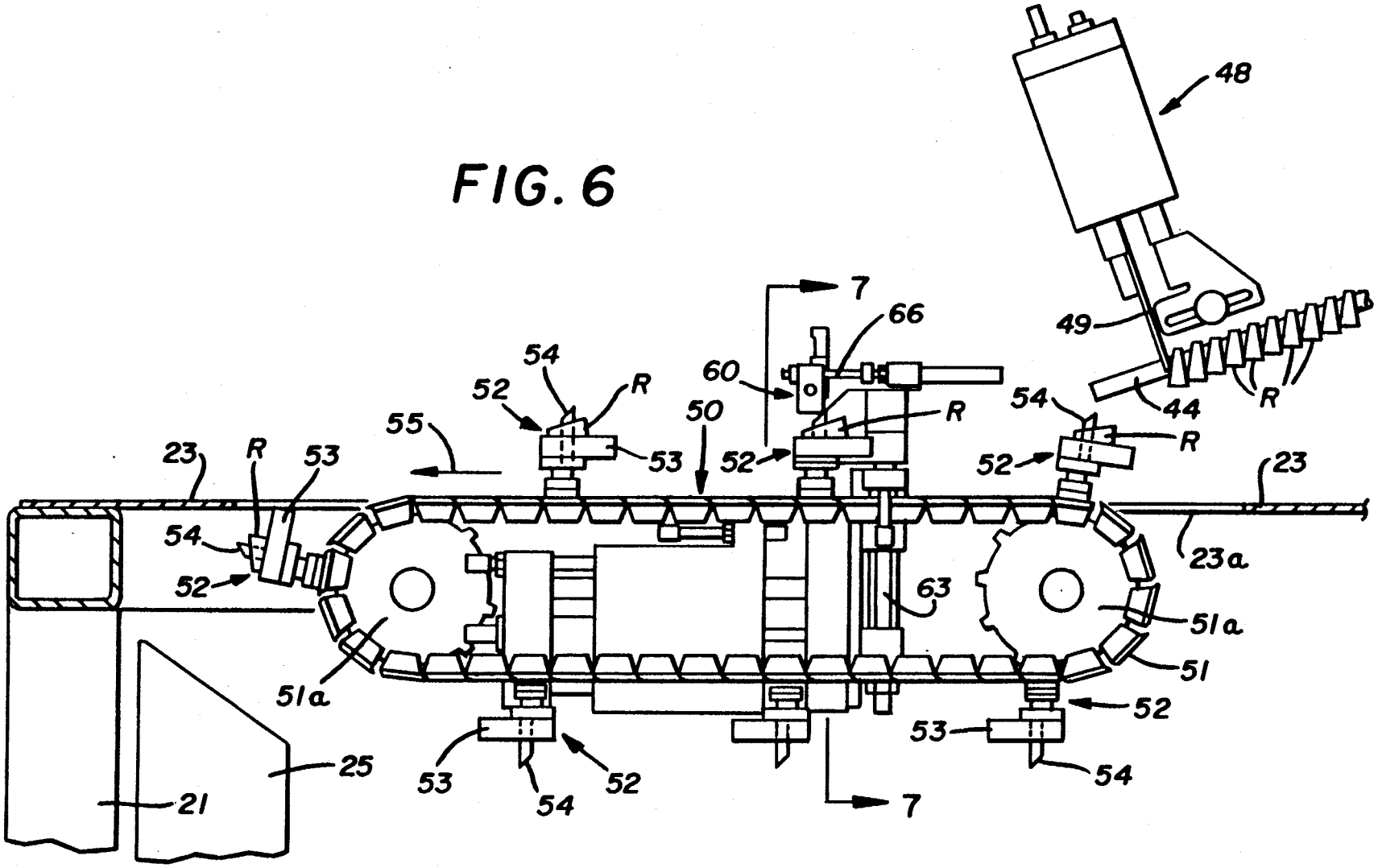
FIG. 6 is a sectional view taken along the line 6—6 of FIG. 5.

Turning then to FIG. 6 of the drawings for a description of the conveying means 50, it will be seen that basically an endless conveyor 51, driven by a sprocket 51a and motor (not shown) in the direction of arrow 55, is provided. As just noted, in the form of the invention illustrated herein, parallel conveyors 51 are illustrated and may be driven by the same motor. These conveyors move across the top of frame 20 and are positioned in appropriate slots 23a,23a of the top surface 23 of the frame.

Each conveyor 51 carries, at spaced intervals, ring carriers 52. These include generally a base 53 affixed to the conveyor and a projecting post 54 which receives the ring R, as can be seen, for example, in FIG. 6 of the drawings. The post may be removably mounted on base 53 so as to provide for utilization of different diameter posts so as to accommodate different size rings, such as men's and women's, or a single, universal diameter may be employed.

The conveyor 51 is driven by the previously mentioned motor and advances the ring carriers 52 incrementally in a path of movement which will eventually bring them into adjacency with the tag or label applying means 60 and the tag or label supply means 70.

Figure 13:
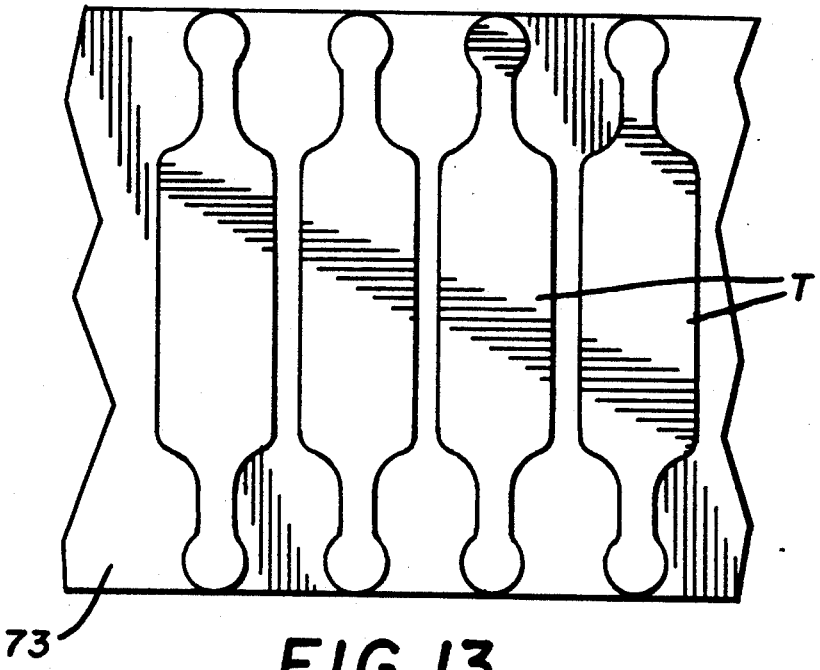
FIG. 13 is an elevational view of strip tags or labels taken along the line 13—13 of FIG. 5.
Figure 5:
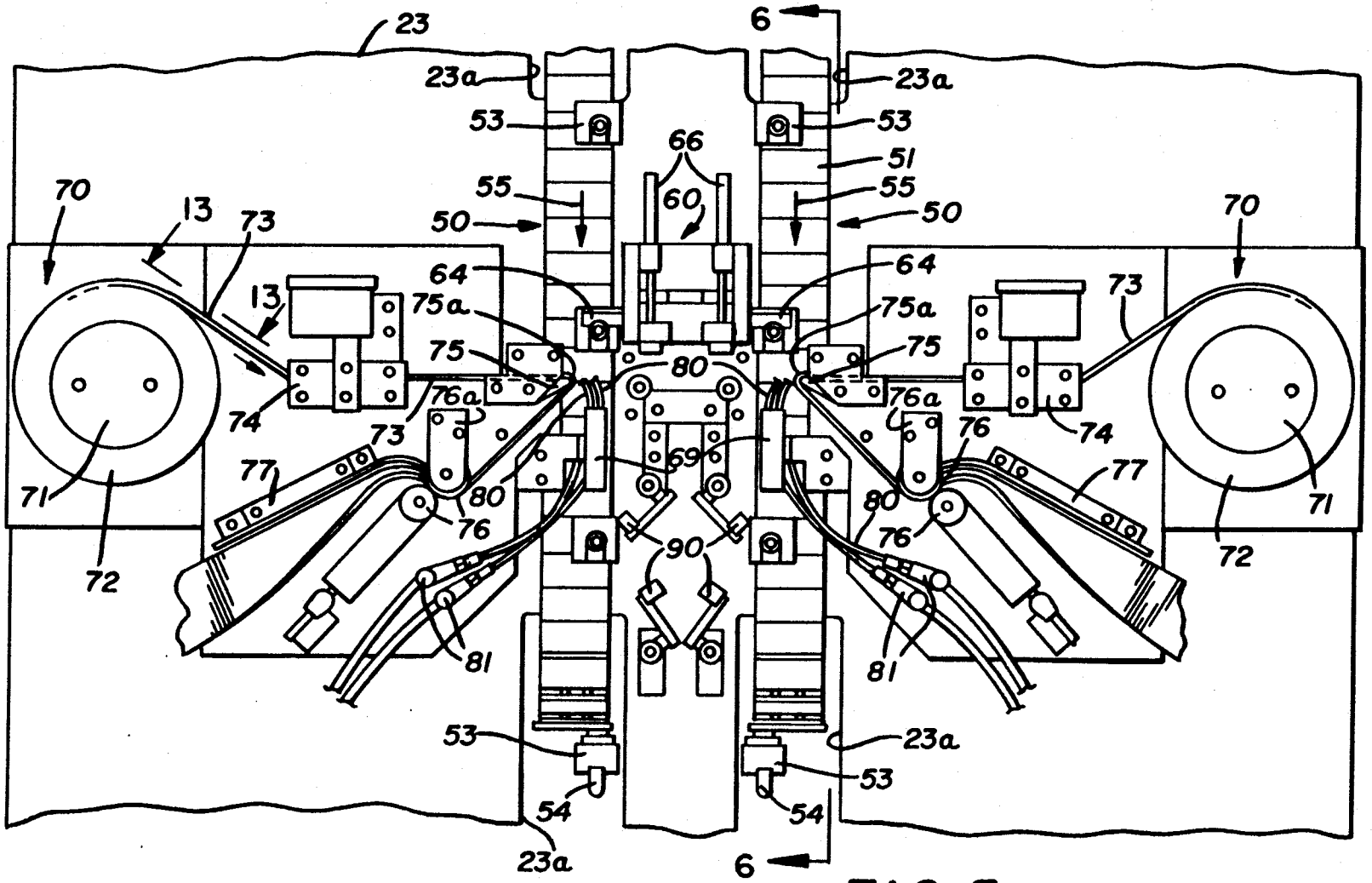
FIG. 5 is a top plan view taken along the line 5—5 of FIG. 1.

In that regard, reference is now made to FIG. 5 of the drawings for an illustration of the tag or label supply means 70. As previously indicated, the tags T are provided with a coating of pressure sensitive adhesive and carried on a roll 72 of release paper 73, as can be seen in FIG. 13. Each roll is disposed on a supply spindle 71, one of which is disposed on each side of conveying means 50, in the form of the invention illustrated herein. The release paper 73 is threaded through a first guide means 74 and around a second guide means 75 and then by way of rollers 76 along guide 77 to either a take-up roll (not shown) or waste receptacle. As will be seen in FIG. 5 of the drawings, this brings the release paper sheet 73 into close proximity with both the conveying means 50 and the tag or label applying means 60.

It will be noted that motors 76a may be associated with rollers 76 so that the rollers may be driven to pull the release paper 73 from the roll 72 as required.

As has previously been noted, the tags or labels T are placed on the release paper by the supplier and carry a coating of pressure-sensitive adhesive. They are, therefore, readily removable from the release paper 73 by suitable means which will now be described. Thus, it will be appreciated that, as the release paper 73 passes around the guide 75, turning the corner 75a, as it were, the tag or label T will tend to continue travel in a straight line toward the conveyor 51 and will tend to begin to separate from release paper 73.

As it does so, pressurized air from the lines 80,80 directed against the face of the tag or label T will assist its removal from the release paper 73. This will also direct the tag or label toward the tag or label applying means 60. Thus, in cooperation with vacuum means carried by the tag or label applying means 60, which will be described below, the tag or label will be transferred from the release paper 73 onto the tag or label applying means 60 and held there, in the posture shown in FIG. 12A or, in other words, in an "open" condition, by the vacuum. They will thus be held in readiness for application to one of the rings.

It will also be noted that there are three air supply lines 80 associated with each tag or label applying means 60 and each is controlled by adjustable controls 81,81. In some applications, it has been found desirable to maintain a constant flow through one of the lines 80 to assist removal from release paper 73 and a one time sharp burst of air through the other at the moment the tag or label T is separating from release paper 73 to assure complete release and transfer to the tag or label applying means 60. It has also been found that the number of lines 80 can be increased if desired and that short, timed bursts can be employed from all lines in some instances.

Turning next, then, to FIGS. 7, 9 through 11 and 14 and 15 for a fuller description of the tag or label applying means 60, it will be seen that these means include a lower frame 61 and an upper frame 62 mounted on the top 23 of main frame means 20. Carried on these frames 61,62 are a first applicator arm 65 and a second applicator arm 64. Each frame 62, as will be noted, also carries an elongate, horizontally disposed arm 66 which carries a rack on it, driven by a suitable piston and cylinder, and which engages a gear 67. In this fashion, the second or upper frame 62 and its associated applicator arm 64 can be pivoted from the position illustrated, for example, in FIGS. 7 and 9 of the drawings to the position illustrated in FIG. 10.

It will also be noted that each upper arm includes one or more apertures 64*a* and each lower arm includes one or more apertures 65*a*, so that a vacuum can be applied to the tag or label T to hold it on the face of the arms 64 and 65 after removal from the release paper 73 with the assistance of air from one or both lines 80,80, as described above.

Figure 7:
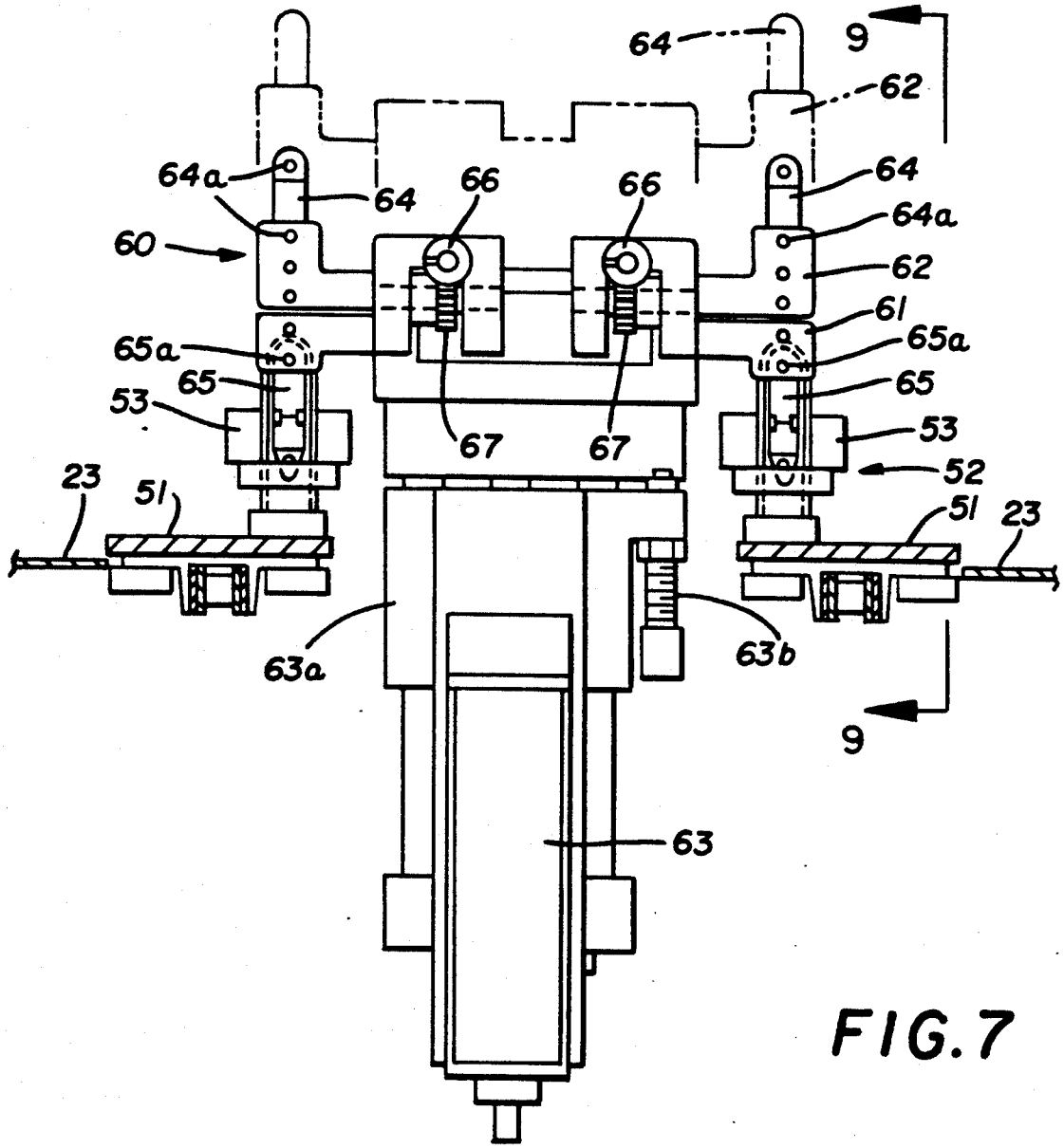
FIG. 7 is a sectional view taken along the line 7—7 of FIG. 6.
Figure 9:
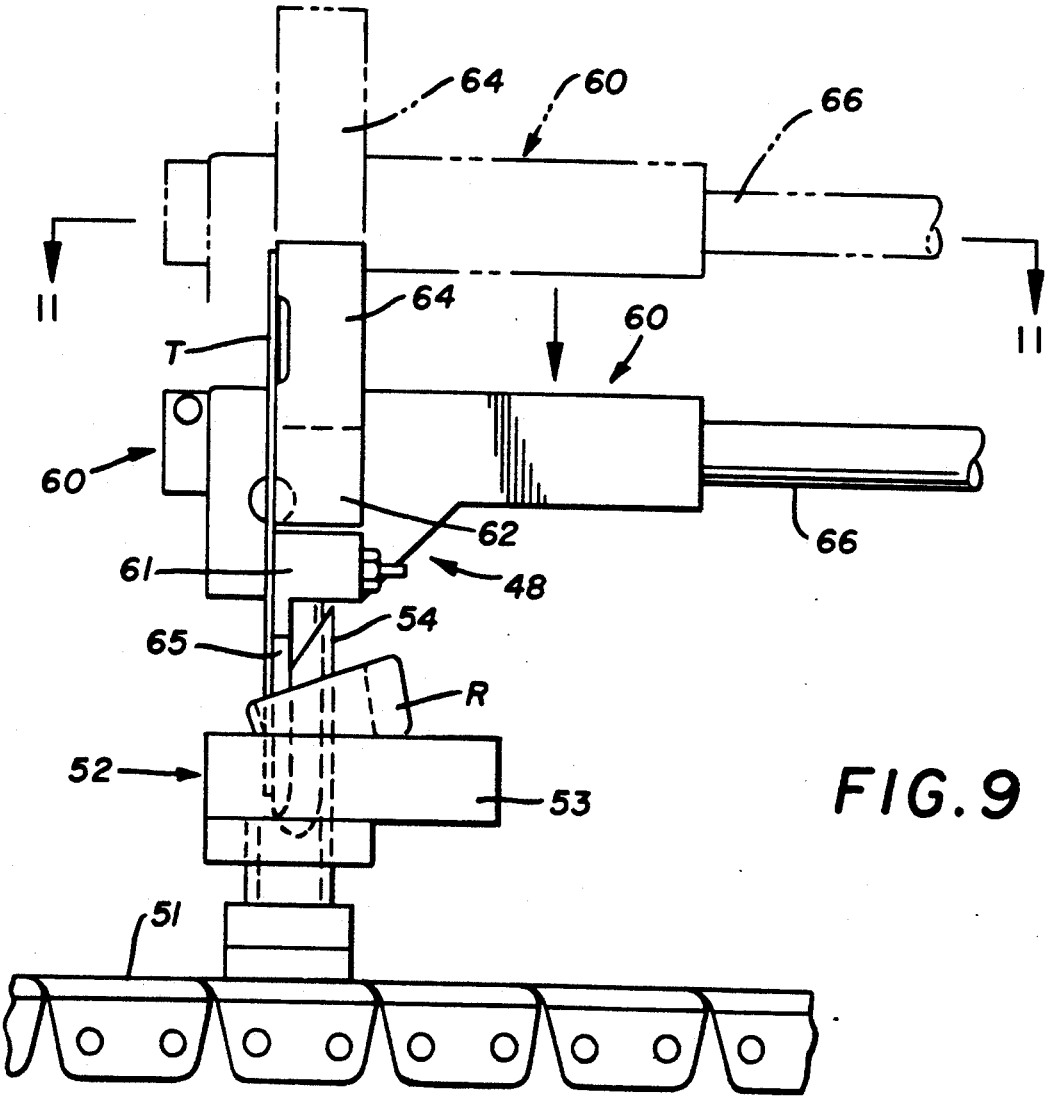
FIG. 9 is an enlarged elevational view of the ring applying means in the open position.

Referring to FIGS. 7 and 9, it will also be noted that a pneumatic or hydraulic piston 63 is provided in supporting engagement with tag or label applying means 60, with this piston making it possible to move the tag or label applying means 60 from the full to the broken line positions of FIGS. 7 and 9. In this fashion, it will be understood that the tag or label applying means 60 is in the chain dotted line position of FIGS. 7 and 9, when it receives the tag or label T from release paper 73, and is then moved to the full line position of those figures in order to apply the tag or label T to the ring R. The stroke of piston 63 is also adjustable by adjustment means 63*b* if required.

Furthermore, the entire assembly 60 is movable in a horizontal plane toward and away from the nose 75*a* of second guide means 75 to receive the tags or labels T, as will now be described. Thus, referring to FIGS. 14 and 15 of the drawings, it will be seen that a linear actuator 68, which may be either pneumatically or hydraulically activated, is mounted on frame means 20 below the top surface 23. Linear actuator 68 includes an activating cylinder 68*a*, guide rods 68*b*,68*b* and piston rod 68*c*. Secured to the end of piston rod 68*c* is a plate 68*d* which, in turn, is secured to piston mount 63*a* of piston 63.

Figure 14:
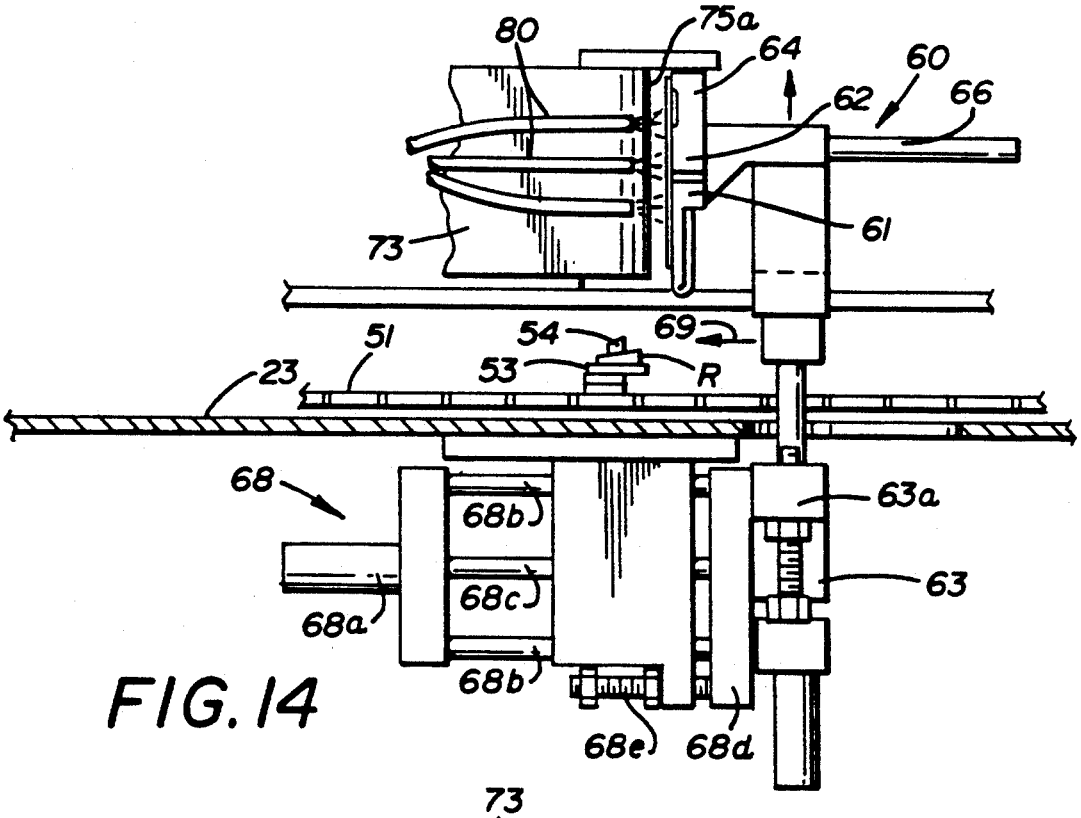
FIG. 14 is a side elevational view of the tag or label applying means in the forward or tag or label receiving position.
Figure 15:
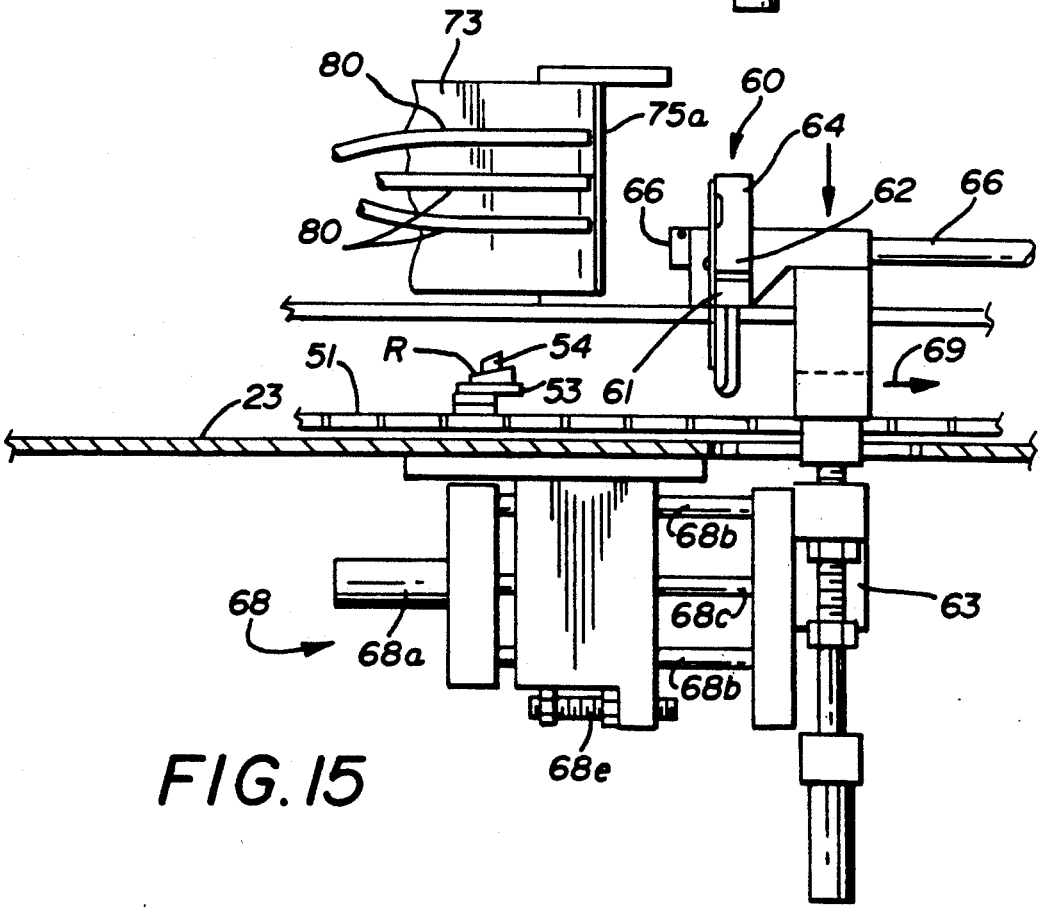
FIG. 15 is a side elevational view of the tag or label applying means in the retracted position.

It will readily be seen from FIGS. 14 and 15 that actuation of linear actuator 68 will cause the entire tag or label applying assembly 60 to move in a horizontal plane in the direction of arrows 69,69, either toward or away from nose 75*a* of second guide means 75 to either receive a tag or label T from release paper 73 or apply the same to the ring. It will also be noted here that the stroke of linear actuator 68 can be adjusted by adjustment means 68*e*.

In use or operation of the invention, it will first be assumed that a plurality of rings R have been supplied to the arms 44,44 of the carousel 40, as can be seen, for example, in FIGS. 6 and 8 of the drawings. At that time, the conveyor 51 is activated and is advanced so that a ring carrier 52 is brought into proximity with the end of an extended arm 44, as can be seen, for example, in FIGS. 6 and 8. The control means 46 is then activated in response to the movement of the conveyor 51 and permits one of the rings R to slide down and onto the post 54 of a ring carrier 52.

As previously mentioned, the article supply means 40 could be dispensed with and the rings R could be simply manually deposited on the ring carriers 52,52 as they emerge from the slot 23*a* of top surface 23 of base 20 and as the post 54 comes into a substantially vertical position through movement of conveyor 51.

In either case, following placement of the rings on the ring carriers, conveyor 51 continues forward in the direction of arrow 55 into proximity with the tag or label applying means 60 and the guide 75 of the supply means 70. At the same time, the release paper 73 carrying the bands is advanced by being pulled from spindle 71 by the driven rolls 76, bringing one of the tags or labels T to the nose 75*a* of the second guide means 75.

At this time, the tag or label applying assembly 60 is advanced to a position adjacent nose 75*a* by linear actuator 68, as can be seen in FIG. 14. As previously described, the tag or label will tend to separate from the release paper 73 by virtue of the change in direction of the release paper and, with the assistance of the air from lines 80,80 located opposite the tag or label applying means 60, will be transferred to the front face of the arms 64 and 65. Also at this time, a ring carrier 52 will be advancing toward a position beneath the tag or label applying means 60 by the continuing advance of conveyor 51.

At this time, a photoelectric eye 69 will sense the presence of the tag or label T on the front face of arms 64 and 65 and activate the vacuum means associated therewith to hold the tag or label in place. The piston 68 will then retract the entire assembly 60 to its starting position, as can be seen in FIG. 15.

At this time, applicator arms 64 and 65 will be positioned above post 54 and, assuming that a ring carrier 52 is positioned beneath it, cylinder 63 will be activated to lower the tag or label applying means 60, for example, from the chain dotted to the full line positions of FIGS. 7 and 9.

Figure 12:
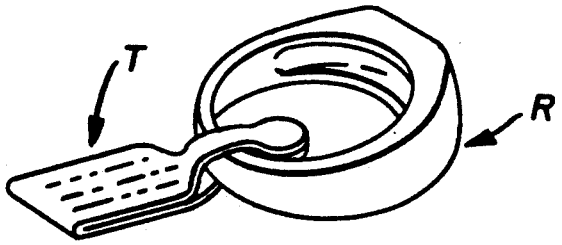
FIG. 12 is a perspective view of a ring as an exemplary article to which the tag or label is applied.
Figure 10:
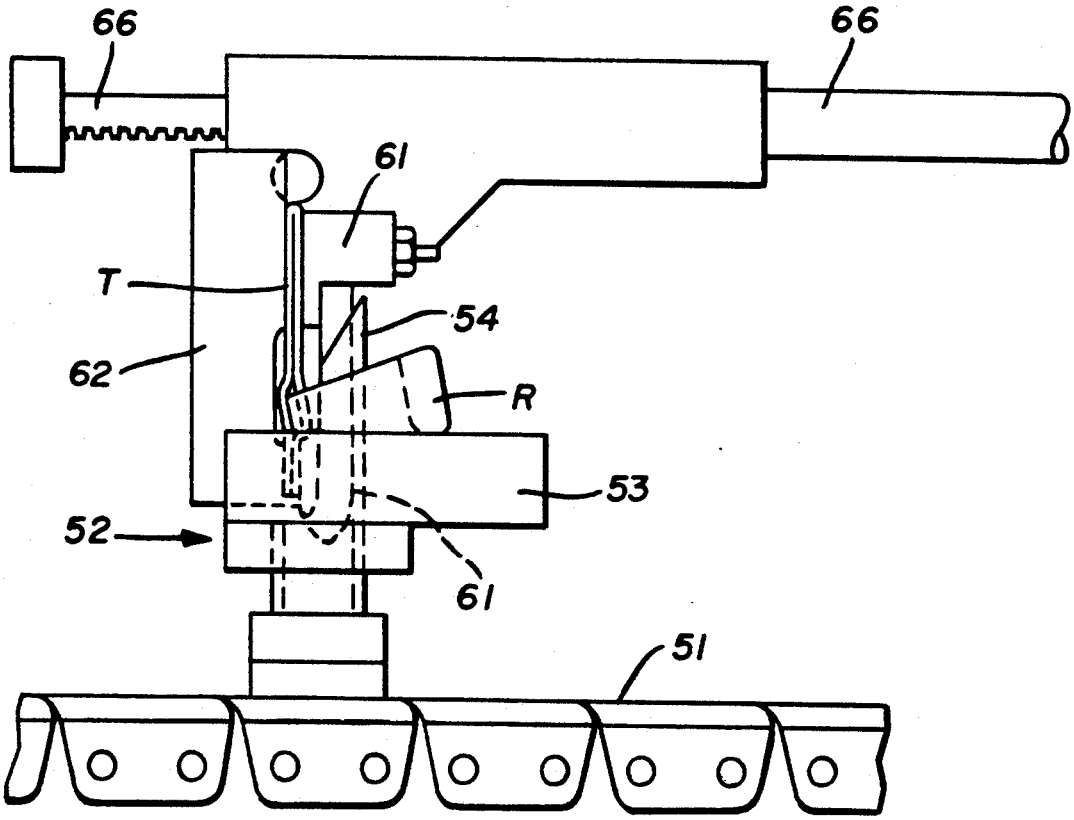
FIG. 10 is a view similar to FIG. 9 showing the tag or label applying means in the closed or application position.

This results in insertion of the lower arm 65 into the ring R. Actuation of the rack and pinion means 66,67 will then cause the upper arm 62 to pivot to the position illustrated in FIG. 10 of the drawings, thereby folding the tag or label T over on itself and about the ring R, bringing the ends of the tag T together, as can be seen in FIG. 10. The pressure sensitive coating on the tags or labels will, of course, insure that the ends of the tags or labels are adhered to each other upon release of the vacuum and firmly in place on the ring R, as can also be seen in FIG. 12.

Following this operation, the rack and pinion means 66,67 are again activated and the tag or label applying means 60 returns to the open position illustrated, for example, in FIGS. 7 and 9 of the drawings, and the cylinder 63 is actuated to raise the tag or label applying means to the chain dotted line positions of FIGS. 7 and 9.

The tag or label supply means 70 is then indexed and the operation is repeated. It will be noted from FIG. 6 that, as the conveyor 51 continues its continuous movement, the ring carrier 52 will move about the perimeter of the sprocket 51*a*, and the tagged ring R will simply drop by gravity into the article container 25 from which it can be removed for further processing.

It will also be noted that sensors 90,90 may be employed downstream from the tag or label applying means 60 to sense whether each ring R has received a tag or label T as required.

While a full and complete description of the invention has been set forth in accordance with the dictates of the Patent Statutes, it will be understood that modifications can be resorted to without departing from the spirit hereof or the scope of the appended claims.

In that regard, it should be noted that, as previously mentioned, while the invention has been illustrated and described in connection with the application of bands to rings, it is not intended to be limited to an operation involving rings alone, but could be used to band or tag other articles as well.

What is claimed is:

1. Apparatus for applying tags to rings or the like, comprising:

a) conveying means for carrying and advancing the rings;

b) supply means for supplying the tags;

c) tag applying means for receiving the tags from said supply means and attaching the tags to the rings;

d) said tag applying means being disposed between said supply means and said conveying means whereby the rings may be advanced to a position adjacent said tag applying means for application of the tags to the rings; and e) said tag applying means including hinged applicator arms movable between an open and closed position with at least one of said applicator arms being movable into and out of the ring whereby the tag may be received on said applicator arms in their open position and attached to the ring upon movement of said applicator arms to their closed position.

2. The apparatus of claim 1 wherein said conveying means include at least one endless conveyor disposed beneath said tag applying means; and one or more ring carriers carried by said conveyor.

3. The apparatus of claim 1 wherein the tags are provided in roll form on a roll of release paper; and said supply means include a roll receiving spindle and means for advancing said release paper past a point adjacent said tag applying means whereby individual tags may be transferred from the release paper to said tag applying means.

4. The apparatus of claim 3 wherein said tag applying means are movable from a position adjacent said supply means to a position remote therefrom.

5. The apparatus of claim 4 wherein said applicator arms are movable vertically in their open position from a position above the ring to a position extending into the ring.

6. The apparatus of claim 1 wherein vacuum means are carried by said tag applying means; and air supply means are disposed opposite said tag applying means and downstream thereof; said supply means being positioned so as to present a tag between said vacuum means and said air supply means.

7. The apparatus of claim 3 wherein said supply means include a take-up roll; and guide means disposed between said roll receiving spindle and said take-up roll and adjacent said tag applying means; said guide means reversing the direction of travel of the release paper with respect to said tag applying means.

8. The apparatus of claim 7 wherein air supply means are disposed downstream of said tag applying means and adjacent said guide means; and vacuum means are carried by said tag applying means whereby labels peeled from the release paper as it passes over said guide means may be transferred to said tag applying means.

9. The apparatus of claim 8 wherein said vacuum means are associated with said applicator arms for attracting the tag to the arms.

10. The apparatus of claim 9 wherein said applicator arms are movable toward and away from said conveying means whereby said first applicator arm may be moved into and out of the ring.

11. Apparatus for applying tags to rings or the like, comprising:

a) conveying means for carrying the rings;

b) tag applying means disposed above said conveying means;

c) tag supply means disposed adjacent said tag applying means for selectively supplying tags to said tag applying means; and d) said tag applying means bearing the tag being selectively movable from a position overlying the rings to a position partially within and partially without the rings and between open and closed positions whereby a tag carried on said tag applying means may be attached about a ring.

12. The apparatus of claim 11 wherein said tag applying means are movable toward and away from said tag supply means.

13. The apparatus of claim 11 wherein said conveying means include at least one endless conveyor; and one or more ring carriers carried by said conveyor for movement therewith.

14. The apparatus of claim 11 wherein said tag applying means include first and second applicator arms; said first applicator arm being moveable into and out of the ring; and said second applicator arm being pivotally movable with respect to said first applicator arm.

15. The apparatus of claim 11 wherein said tag applying means include a source of vacuum for attracting the tag thereto.

16. The apparatus of claim 15 wherein air pressure means are disposed adjacent said tag applying means for removing the tags from said tag supplying means and transferring them to said tag applying means.

17. The apparatus of claim 15 wherein said tag supply means include a spindle for receiving a roll of release paper carrying a quantity of tags; a series of guide means are provided for directing the release paper to a point adjacent said tag applying means; at least one of said guide means reversing the direction of travel of said release paper whereby the tag tends to separate from the release paper at the point of reversal; and air pressure means disposed adjacent the point of reversal and directing the tag toward said tag applying means.

18. A method for applying tags from a roll of release paper containing the bands to a series of rings, comprising the steps of:

a) advancing the rings along a path of travel;
b) incrementally advancing the release paper along a path of travel substantially transverse to the path of travel of the rings;
c) transferring a tag from the release paper to a tag applying means disposed in the path of travel of the rings;
d) selectively inserting the tag applying means into the ring;
e) applying a tag to the ring;
f) withdrawing the tag applying means; and
g) repeating steps a through f.

19. The method of claim 18 wherein the release paper is first advanced toward the tag applying means and then about a guide member and then away from the tag applying means whereby a tag is released from the release paper as it passes around the guide member.

20. The method of claim 19 wherein the tag applying means are advanced toward the guide member before step c to receive a tag and then away from the guide means before step d.

21. The method of claims 19 or 20 wherein a tag is transferred from the release paper to the tag applying means by directing air against one surface thereof and applying a vacuum from the tag applying means to the opposed surface thereof.

22. The method of claim 19 wherein the tag applying means include hinged first and second applicator arms and step d includes inserting the first applicator arm into the ring and step e includes closing the second applicator arm about the outside of the ring.

23. Apparatus for applying tags to rings or the like, comprising:

a) conveying means for carrying and advancing the rings;
b) supply means for supplying the tags;
c) tag applying means for receiving the tags from said supply means and attaching the tags to the rings;
d) said tag applying means being disposed between said supply means and said conveying means whereby the rings may be advanced to a position adjacent said tag applying means for application of the tags to the rings;
e) said tags being provided in roll form on a roll of release paper;
f) said supply means including a roll receiving spindle and means for advancing said release paper past a point adjacent said tag applying means whereby individual tags may be transferred from the release paper to said tag applying means;
g) said supply means also including a take-up roll;
h) guide means disposed between said roll receiving spindle and said take-up roll and adjacent said tag applying means for reversing the direction of travel of the release paper with respect to said tag applying means;
i) air supply means disposed downstream of said tag applying means and adjacent said guide means;
j) vacuum means carried by said tag applying means whereby labels peeled from the release paper as it passes over said guide means may be transferred to said tag applying means;
k) said tag applying means including first and second applicator arms movable between open and closed positions;
l) vacuum means being associated with said applicator arms for attracting the tag to the arms; and
m) said applicator arms being movable toward and away from said conveying means whereby said first applicator arm may be moved into and out of the ring.

24. Apparatus for applying tags to rings or the like, comprising:

a) conveying means for carrying the rings;
b) tag applying means disposed above said conveying means;
c) tag supply means disposed adjacent said tag applying means for selectively supplying tags to said tag applying means;
d) said tag applying means being selectively movable from a position overlying the rings to a position partially within the rings and between open and closed positions whereby a tag carried on said tag applying means may be attached to a ring;
e) said conveying means including at least one endless conveyor;
f) one or more ring carriers carried by said conveyor for movement therewith; and
g) said tag applying means also including first and second applicator arms
   1) said first applicator arm being moveable into and out of the ring and
   2) said second applicator arm being pivotally movable with respect to said first applicator arm.

* * * * *